US005819365A

United States Patent [19]

Huffman et al.

[11] Patent Number: 5,819,365

[45] Date of Patent: Oct. 13, 1998

[54] WINDOW WASHING ACCESSORY CLEANING TOOL FOR USE WITH WATER EXTRACTION CLEANING MACHINE

[75] Inventors: Eric C. Huffman, Lowell, Mich.; Kevin Ma Kam Hoi; Ng Tat Shing, both of Kwai Chung, Hong Kong; Hok Yin Timmy Sin, Tsuenwan, Hong Kong

[73] Assignee: Bissell Inc., Grand Rapids, Mich.

[21] Appl. No.: 683,608

[22] Filed: Jul. 15, 1996

Related U.S. Application Data

[60] Provisional application No. 60/003,416 Sep. 8, 1995.

[51] Int. Cl.[6] ..... A47L 1/02

[52] U.S. Cl. ..... 15/321; 15/322; 15/367; 15/393; 15/401

[58] Field of Search ..... 15/321, 322, 367

[56] References Cited

U.S. PATENT DOCUMENTS

| | | |
|---|---|---|
| 2,867,835 | 1/1959 | Brown, Jr. et al. . |
| 3,254,360 | 6/1966 | Hageman . |
| 3,538,535 | 11/1970 | Ginsburgh et al. . |
| 3,584,330 | 6/1971 | Wallin et al. . |
| 4,557,013 | 12/1985 | Belmont . |
| 4,696,074 | 9/1987 | Cavalli . |
| 4,776,716 | 10/1988 | Huang . |
| 4,833,752 | 5/1989 | Merrick . |
| 4,910,828 | 3/1990 | Blase et al. . |
| 5,007,753 | 4/1991 | England, Jr. . |
| 5,067,199 | 11/1991 | Alazet . |
| 5,184,372 | 2/1993 | Mache . |
| 5,280,666 | 1/1994 | Wood et al. . |
| 5,497,530 | 3/1996 | Kamm et al. . |

FOREIGN PATENT DOCUMENTS

| | | |
|---|---|---|
| 0 176 696 | 2/1985 | European Pat. Off. . |
| 0 381 783 | 8/1990 | European Pat. Off. . |
| 0 547 267 | 6/1993 | European Pat. Off. . |
| 1526754 | 4/1968 | France . |
| 2092707 | 1/1972 | France . |
| 2218867 | 9/1974 | France . |
| 2265336 | 10/1975 | France . |
| 2345977 | 3/1976 | France . |
| 2572920 | 6/1986 | France . |
| 2665650 | 2/1992 | France . |
| 1939967 | 5/1970 | Germany . |
| 3 017 485 | 11/1981 | Germany . |
| 34 47 774 | 7/1985 | Germany . |
| 85 29 619.8 | 10/1985 | Germany . |
| 40 04 855 | 8/1991 | Germany . |
| 94 05 546.7 | 3/1994 | Germany . |
| 94 05 547.5 | 3/1994 | Germany . |
| 94 05 755.9 | 4/1994 | Germany . |
| 1271002 | 4/1972 | United Kingdom . |
| WO 93/18698 | 9/1993 | WIPO . |

OTHER PUBLICATIONS

Karcher Window Washer Product Brochure, 1993.

Balai Magic Brochure, undated.

*Primary Examiner*—Chris K. Moore

*Attorney, Agent, or Firm*—Rader, Fishman, Grauer & McGarry

[57] ABSTRACT

A window washing accessory cleaning tool adapted for use with a water extraction cleaning machine has a solution spray nozzle integrated therewith and a combination suction and scrubbing head rotatably mounted with respect to the solution spray nozzle. The cleaning solution spray nozzle is provided on one side of a dual conduit support member and a head is rotatably mounted to the dual conduit support member. A foam applicator/scrub pad is provided along one end of the head and a suction nozzle opening defined by a squeegee blade and a rigid flange are provided one the other side of the head. With this structure, the applicator/scrub pad and suction nozzle can be rotated with respect to the cleaning solution spray nozzles, thereby making the accessory cleaning tool adaptable for a wide variety of cleaning operations. Preferably, the window washing accessory cleaning tool is removably mounted to the end of the flexible hose.

21 Claims, 2 Drawing Sheets

WINDOW WASHING ACCESSORY CLEANING TOOL FOR USE WITH WATER EXTRACTION CLEANING MACHINE

This application claims the benefit of U.S. Provisional Application No. 60/003,416 filed on Sep. 8, 1995.

BACKGROUND OF THE INVENTION

1. Field of the Invention

This invention relates to water extraction cleaning machines and more particularly, to a window washing cleaning tool with a rotatable head adapted for use with the extraction cleaning machine.

2. Description of the Related Art

Water extraction cleaning machines are used for cleaning a variety of surfaces including carpet, upholstery, bare floors, and windows. The cleaning process comprises the steps of directing a water and cleaning solution spray at the surface to be cleaned. Next, vacuum is applied to remove at least a portion of the solution mixture along with dirt and dust entrained in the solution.

In a typical water extraction cleaning machine, flexible vacuum and cleaning solution hoses extend from a machine housing which supports a vacuum motor, a clean solution reservoir, a solution pump, and a dirty solution reservoir. A variety of tools or attachments have been developed for coupling to the terminal end of the flexible hose for different cleaning operations. For example, one known accessory tool comprises a floor engaging cleaning tool having a fan-shaped suction nozzle fluidly connected to the vacuum hose and a cleaning fluid spray nozzle connected to the cleaning solution hose. Another known tool is an upholstery cleaning tool, again having a fan-shaped suction nozzle and a fluid spray nozzle. As seen in PCT Patent Application No. WO 93/18698 to Leroux, French Patent Application No. 2 345, 977 to Huther, and German Utility Model Patent No. G 94 05 546.7, it is known to provide a window washing or hard surface cleaning tool to one end of the vacuum and solution hoses of a cleaning machine.

One problem with the known window washing tools is the limitations in the adaptability of the tool for a variety of cleaning operations. For example, while some window washing tools include a foam applicator pad and a squeegee blade adjacent the spray nozzle and vacuum suction nozzle, none of the known tools provide means for adapting and altering the position of the spray nozzle relative to the applicator pad, squeegee blade, and vacuum suction nozzle thereby limiting the possible uses of the tool.

SUMMARY OF THE INVENTION

The window washing tool according to the invention overcomes the problems of the prior art by mounting the applicator pad, squeegee blade, and vacuum suction nozzle for rotation with respect to the cleaning fluid spray nozzle so that the tool can be quickly and easily adapted for a variety of cleaning applications.

In one aspect, the invention comprises an accessory cleaning window washing tool adapted to be used with a water extraction cleaning machine. Typically, the cleaning machine has a vacuum conduit and a solution conduit extending therefrom. The window washing tool comprises a support member having a working air passageway provided therein which is fluidly connected to the vacuum conduit of the cleaning machine. A cleaning solution spray nozzle is provided on the support member and is fluidly connected to the solution conduit of the cleaning machine. The cleaning solution spray nozzle is adapted to distribute cleaning solution onto a surface to be cleaned. A cleaning head is rotatably mounted to the support member. The cleaning head has first and second opposed edges. An applicator pad is provided on the first edge and the second edge has front and rear flanges defining a suction nozzle opening. A conduit extends between the suction nozzle opening and the working air passageway of the support member. The cleaning head is rotatably mounted to the support member so that the alignment of the cleaning solution spray nozzle can be varied with respect to the suction nozzle opening and the applicator pad for different applications of the accessory cleaning tool.

Preferably, the cleaning head is rotatable on the support member for movement between first and second positions. In the first position, the cleaning solution spray nozzle is adjacent the applicator pad. In the second position, the cleaning solution spray nozzle is adjacent the suction nozzle opening. The ability to selectively alter the orientation of the cleaning head with respect to the cleaning solution spray nozzle make the accessory cleaning tool adaptable for a wide variety of cleaning operations. For example, when the spray nozzle is adjacent the applicator pad, cleaning solution can be selectively sprayed onto the surface to be cleaned and scrubbed and distributed with the applicator pad. The user can then rotate the support member and grip tube and remove the used cleaning solution through the suction nozzle opening. In the second position, the cleaning solution can be simultaneously sprayed and removed from the surface being cleaned because the cleaning solution spray nozzle is adjacent the suction nozzle opening. By selectively controlling the distribution of cleaning solution with a trigger and selectively controlling the operation of the vacuum motor in the cleaning machine, a wide variety of modifications to the cleaning processes described above can be achieved.

Preferably, the cleaning head is mounted to the support member for rotation about an axis substantially parallel to the longitudinal axis of the working air passageway. Preferably, the support member comprises a substantially tubular first bearing surface and the head comprises a substantially tubular second bearing surface wherein the first and second bearing surfaces slide along one another as the head is rotated with respect to the support member. O-rings can be provided on one of the bearing surfaces to create a substantially air and fluid tight seal between the two surfaces.

In another embodiment, a pair of notches are provided on the cleaning head and a spring-biased trigger mechanism is provided on the support member. The spring-biased trigger is received in one of the notches which correspond to the above-mentioned first and second positions.

In still another embodiment of the accessory cleaning tool, a plurality of projections depend from the rear flange of the cleaning head, second edge. The projections are adapted to space the rear edge from the surface being cleaned so that fluid, dirt and air can pass beneath the rear edge into the suction nozzle opening.

BRIEF DESCRIPTION OF THE DRAWINGS

The invention will now be described with reference to the drawings in which.

DETAILED DESCRIPTION OF THE PREFERRED EMBODIMENTS

Figure 1:
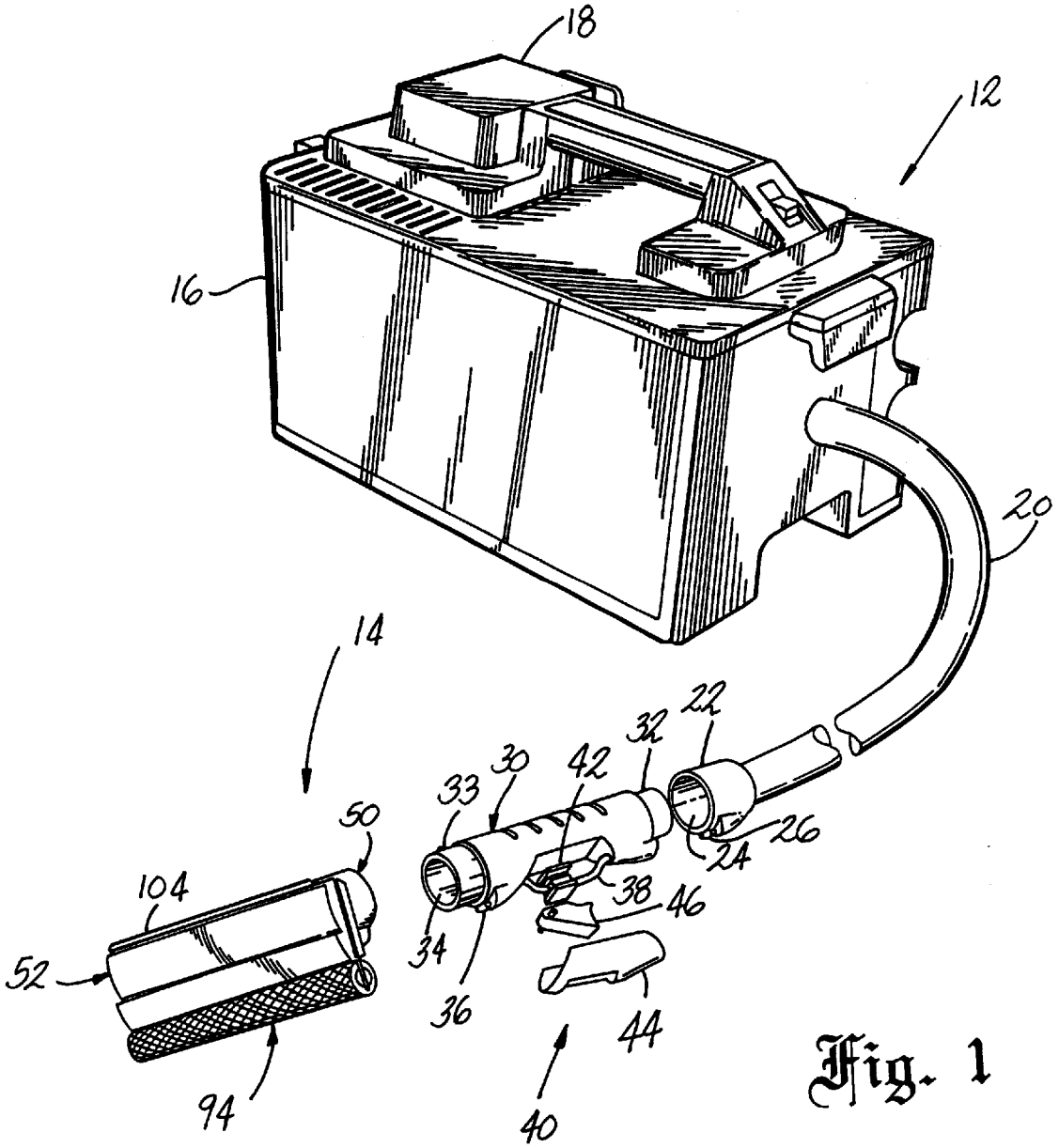
FIG. 1 is a perspective view of a conventional water extraction cleaning machine incorporating a window washing cleaning tool according to the invention.

Referring now to the drawings and to FIG. 1 in particular, a water extraction cleaning machine 12 including an accessory cleaning tool, specifically a window washing cleaning tool 14, according to the invention is shown. The water extraction cleaning machine comprises a housing 16 having a clean water solution reservoir (not shown), a fluid pump (not shown), a dirty solution reservoir (not shown), a vacuum motor (not shown), a concentrated cleaning solution container 18, and a flexible hose 20 extending therefrom. In this embodiment, the hose 20 is conventional in the art and has a working air conduit fluidly connected to the vacuum motor and dirty solution reservoir and a solution conduit fluidly connected to the fluid pump, clean water reservoir, and concentrated cleaning solution container 18. The working air conduit and solution conduit can be integrated with one another or independent from one another. A more complete description of the water extraction cleaning machine according to the invention illustrated in FIG. 1 is found in U.S. Pat. No. 4,910,828, issued Mar. 27, 1990 to Blase et al., which is expressly incorporated herein by reference.

The water extraction cleaning machine shown in FIG. 1 is a compact water extraction cleaning machine. However, the window washing tool 14 according to the invention can be used with any water extraction cleaning machine adapted for use with an accessory hose including a canister-type water extraction cleaning machine as disclosed in U.S. Pat. Nos. 5,287,587 issued Feb. 22, 1994 to Yonkers et al. and 5,086,537, issued Feb. 11, 1992 to McDowell et al. and an upright water extraction cleaning machine as shown in U.S. Pat. No. 5,406,673 issued Apr. 18, 1995 to Bradd et al. all of which are expressly incorporated herein by reference.

In the embodiment shown in FIG. 1, one end of the hose 20 is secured to the housing 16 and the other end of the hose has an end fitting 22 provided thereon having a working air passageway 24 and a male solution fitting 26 extending therefrom. The working air passageway 24 opens into the working air conduit of the flexible hose 20. Similarly, the male solution fitting 26 is in fluid communication with the solution conduit of the flexible hose 20.

A grip tube 30 is selectively mounted to the end fitting 22 of the hose 20. The grip tube 30 comprises a first collar 32 formed on one end of the tube, wherein the first collar 32 is adapted to be telescopically received inside the working air passageway 24 of the end fitting 22 and a female solution fitting (not shown) is adapted to telescopically receive the male solution fitting 26 of the end fitting 22. Opposite the first collar 32, the grip tube 30 comprises a second collar 33 having a working air passageway 34 formed therein and an adjacent male solution fitting 36. A working air conduit extends through the grip tube between the two collars 32, 33. Similarly, a flexible solution conduit 38 extends the length of the grip tube 30 interconnecting the female solution fitting adjacent the collar 32 and the male solution fitting 36.

A trigger mechanism 40 is provided on the underside of the grip tube 30 for controlling the distribution of cleaning solution onto the surface to be cleaned. The trigger mechanism comprises a solution conduit support member 42, a trigger mounting member 44, and a pivotally mounted trigger 46. The trigger 46 is pivotally mounted to the trigger mounting member 44 which is in turn mounted to the grip tube 30. The trigger 46 is biased to cooperate with the solution conduit support member 42 to selectively pinch closed the flexible solution conduit 38 in the relaxed position. As the user squeezes the trigger 46 relative to the grip tube 30 sufficient to overcome the bias, the solution conduit 38 is opened so that pressurized cleaning solution supplied by the fluid pump in the housing 16 flows through the conduit 38.

The window washing tool 14 is quickly and easily mounted to the grip tube 30. An aperture 80 is adapted to receive a conventional flexible, biased, locking tab 82 (FIG. 3) provided on the second collar 33 of the grip tube 30 for securing the window washing tool 14 to the grip tube 30. When it is desired to remove the window washing tool 14 from the grip tube 30, the user merely depresses the locking tab 82 and slides the window washing tool 14 longitudinally, away from the grip tube 30.

Figure 2:
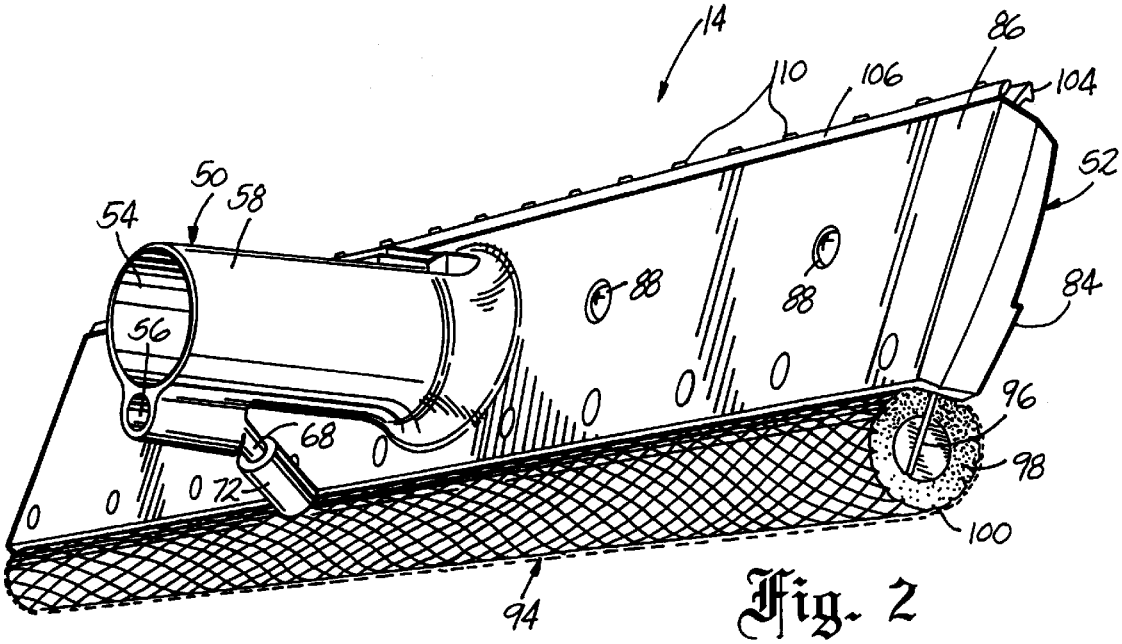
FIG. 2 is a rear perspective view of a window washing cleaning tool for use with the water extraction cleaning machine according to the invention.
Figure 3:
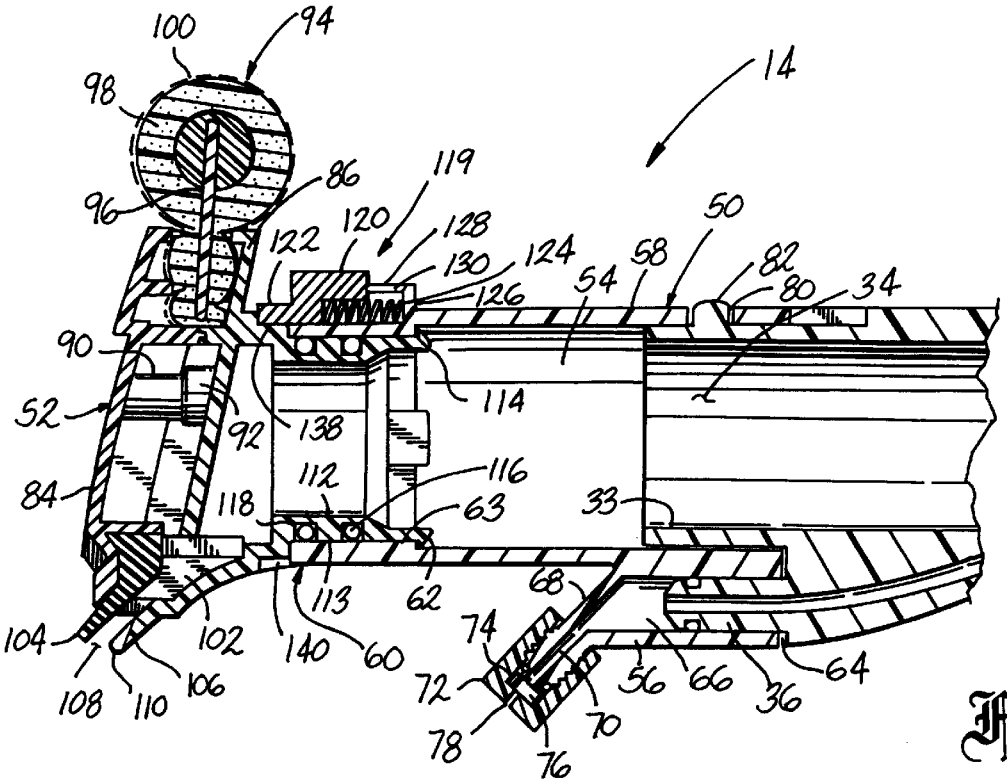
FIG. 3 is a sectional view of the assembled window washing cleaning tool and grip tube taken along lines 3—3 of FIG. 1.

Referring now to FIGS. 1–3, the window washing tool 14 is shown in greater detail and comprises a dual conduit support member 50 and a head 52 rotatably mounted to the support member 50. The support member 50 comprises a vacuum conduit 54 and a cleaning solution conduit 56 provided therein. The vacuum conduit 54 comprises a main body portion 58 and a head supporting portion 60 wherein the head supporting portion has a diameter slightly less than the main body 58 so that a locking surface 62 is formed on the inside surface at the junction of these two portions. A first bearing surface 63 is provided on the exterior surface of the head supporting portion 60.

The cleaning solution conduit 56 comprises an inlet 64, a hollow, fluid chamber 66 and an outlet projection 68 extending from one end of the conduit 56. A fluid flow passageway 70 is formed in the outlet projection 68 and the passageway 70 fluidly communicates with the nozzle chamber 66. The exterior surface of the outlet projection 68 is threaded and adapted to threadably receive a complementary threaded spray nozzle member 72. The nozzle member 72 is adapted to be threaded onto the outlet projection so that a disc chamber 74 is formed inside the nozzle member 72 immediately adjacent the terminal end of the outlet projection 68 and fluid flow passageway 70. A rotating disc 76 is received in the disc chamber 74 and is adapted to distribute pressurized cleaning solution through an outlet 78 provided in the spray nozzle member 72. The disc 76 rotates inside the disc chamber 74 as the pressurized solution is forced into the chamber 74. Rotation of the disc 76 creates a desirable solution distribution from the outlet 78 of the nozzle member 72.

The head 52 comprises a front member 84 which is securely mounted to a rear member 86 by a plurality of conventional fasteners such as screws 88. Each screw 88 extends through a boss 92 provided in the rear member 86 to a threaded seat 90 provided in the front member 84. An applicator/scrub pad 94 is captured between the top edges of the front and rear members 84, 86. The pad 94 comprises an elastomeric support member 96, a foam body 98 surrounding the elasotemeric support member 96 and abrasive netting 100 surrounding the foam body 98. The foam body absorbs fluid such as the cleaning solution for application onto a surface to be cleaned, the elastomeric body provides some limited strength and resiliency to the pad 94 during use and the netting 100 provides means for scrubbing the surface being cleaned.

A squeegee blade 104 is provided adjacent the bottom edge of the front member 84 and supported therein by a plurality of support ribs 102 which project forwardly from the rear member 86 to capture the blade 104 between the front and rear members 84, 86. The blade 104 is preferably formed from an elastomeric material and is spaced from a rigid flange 106 provided on the bottom, forward edge of the rear member 86. A suction nozzle opening 108 is provided between the blade 104 and the flange 106. The suction nozzle opening 108 is in fluid communication with the vacuum conduit 54 of the support member 50. The ribs 102 are intermittently spaced along the length of the blade 104 sufficient to capture the blade 104 without excessively restricting the air flow through the suction nozzle opening 108. A plurality of projections 110 are provided along the terminal end of the rigid flange 106 to space the rigid flange 106 from the surface being cleaned thereby permitting fluid, dirt and air to pass beneath the flange 106 into the suction nozzle opening 52.

A circular boss 112 extends rearwardly from the rear member 86 and is telescopically received in one end of the vacuum conduit 54. The exterior surface of the boss 112 comprises a second bearing surface 113 which contacts the first bearing surface 63 of the support member 50. A plurality of locking fingers 114 are formed on the rear, terminal edge of the boss 112 and extend radially outwardly therefrom. The locking fingers 114 engage the locking surface 62 integrally formed on the interior surface of the vacuum conduit 54 to retain the rotating head 52 inside the conduit 54. One or more O-rings 116 are provided in grooves 118 formed in the external surface of the circular boss 112. The O-rings encircle the boss 112 to provide a substantially fluid and airtight seal between the boss 112 and the interior surface of the vacuum conduit 54.

The head 52 is rotatably mounted to the dual conduit support member 50 such that the head 52 rotates about the longitudinal axis of the vacuum conduit 54. The circular boss 112 is telescopically received inside the vacuum conduit 54 with the bearing surfaces 63, 113 contacting one another so that the head 52 can rotate with respect to the vacuum conduit 54. However, the contact between the locking fingers 114 and the locking surface 62 prevent inadvertent removal of the head 52 from the support member 50.

A spring biased trigger mechanism 119 is provided on top of the vacuum conduit 54. The trigger mechanism comprises a locking projection 122 formed at the leading edge of the trigger 120 and a spring 124 adapted to bias the trigger 120 into the extended position. The spring 124 and trigger 120 are retained in a recess defined by a rear wall 126 and a pair of opposed side walls 128. The side walls 128 have a pair of inwardly extending flanges 130 which extend over the top of a portion of the trigger body 120 in order to retain the trigger within the recess.

A pair of notches 138, 140 are formed in the rear member 86 and are adapted to selectively receive the locking projection 122 of the trigger 120. As seen in FIG. 3, the spring 124 biases the locking projection 122 into the notch 138 when the trigger 120 and notch 138 are properly aligned. The user can quickly and easily rotate the head 52 with respect to the support member 50 about the longitudinal axis of the vacuum conduit 54 by retracting the trigger 120 until the locking projection 122 is removed from the notch 138 and then rotating the head 52. When the second notch 140 is aligned with the trigger locking projection 122, the trigger 120 is released and received in the notch 140 to lock the head 52 in position with respect to the dual conduit support member 50.

In the orientation depicted in FIG. 2, the spray nozzle of the window washing tool 14 can be used to direct a spray of pressurized cleaning solution onto the surface being cleaned at a point immediately behind the applicator/scrub pad 94. After cleaning solution has been applied, the user can scrub the surface being cleaned with the pad 94. For removal of the used cleaning solution, the user merely rotates the grip tube 30 and window washing tool 14 so that the squeegee blade 104 and flange projections 110 abut the surface to be cleaned. As vacuum is applied to the vacuum conduit 54 through the grip tube 30 and flexible hose 20 and the user draws the unit across the surface to be cleaned, the squeegee blade 104 collects the water and dirt which are then removed as a result of the vacuum applied through the suction nozzle opening 108. The projections 110 provided on the end of the rigid flange 106 space the flange 106 from the surface being cleaned so that air and liquid will enter the suction nozzle opening 108 along substantially the entire length of the opening as the window washing tool 14 is drawn across the surface being cleaned.

The head 52 can be quickly and easily rotated with respect to the grip tube 30 and dual conduit support member 50 by withdrawing the trigger 120 until the locking projection 122 is withdrawn from the first notch 138. The head 52 is rotated approximately 180° with respect to the support member 50 until the locking projection 122 is received in the second notch 140 oriented opposite the first notch 138. In the orientation seen in FIG. 3, the spray nozzle can direct the solution spray to a point immediately behind the suction nozzle opening 108. In this orientation, the user can simultaneously apply cleaning solution to the surface to be cleaned and remove it therefrom. The solution trigger on the grip tube 30 gives the user the ability to control the application of the cleaning solution and the rotatable head provides the user the option of simultaneously spraying and scrubbing the surface without removing the cleaning solution (as seen in FIG. 2) or simultaneously applying cleaning solution and removing it therefrom through the suction opening (as seen in FIG. 3). With this structure, the window washing tool according to the invention can be easily adapted for a variety of cleaning operations. The tool 14 is ideally suited for cleaning windows, but, as can be easily understood, the tool can be used for cleaning virtually any hard, substantially planar surface.

Reasonable variation and modification are possible within the spirit of the foregoing specification and drawings without departing from the scope of the invention.

The embodiments for which an exclusive property or privilege is claimed are defined as follows:

1. An accessory cleaning tool adapted to be used with a water extraction cleaning machine having a vacuum conduit and a solution conduit extending therefrom, the accessory cleaning tool comprising:

a support member having a working air passageway provided therein which is fluidly connected to the vacuum conduit of the cleaning machine and a cleaning solution spray nozzle provided thereon fluidly connected to the solution conduit of the cleaning machine to distribute cleaning solution onto a surface to be cleaned; and a cleaning head having first and second opposed edges, the first edge having an applicator pad provided thereon and the second edge having front and rear flanges defining a suction nozzle opening, a conduit between the suction nozzle opening and the working air passageway of the support member, and the cleaning head is rotatably mounted to the support member so that the alignment of the cleaning solution spray nozzle can be varied with respect to the suction nozzle opening and the applicator pad for different applications of the accessory cleaning tool.

2. An accessory cleaning tool according to claim 1 wherein the cleaning head is rotatable on the support member between a first position in which the cleaning solution spray nozzle is adjacent the applicator pad and a second position in which the cleaning solution spray nozzle is adjacent the suction nozzle opening.

3. An accessory cleaning tool according to claim 2 wherein the working air passageway has a longitudinal axis and the head is mounted to the support member for rotation about an axis substantially parallel to the longitudinal axis of the working air passageway.

4. An accessory cleaning tool according to claim 3 wherein the support member further comprises a substantially tubular first bearing surface and the head further comprises a substantially tubular second bearing surface wherein the second bearing surface slides along the first bearing surface as the head is rotated with respect to the support member.

5. An accessory cleaning tool according to claim 4 and further comprising at least one groove formed in one of said first and second bearing surfaces and at least one O-ring received in said at least one groove, the O-ring being adapted to provide a substantially air and fluid tight seal between the first and second bearing surfaces.

6. An accessory cleaning tool according to claim 4 wherein the first bearing surface comprises at least a portion of the working air passageway and at least a portion of the second bearing surface is telescopically received inside the first bearing surface.

7. An accessory cleaning tool according to claim 6 and further comprising at least one flexible locking projection provided on the second bearing surface and a locking surface formed on the inner surface of the working air passageway and substantially perpendicular to the first bearing surface, the at least one flexible locking projection being adapted to contact the locking surface to prevent inadvertent removal of the head from the support member.

8. An accessory cleaning tool according to claim 1 and further comprising a locking projection provided on one of the head and support member and at least one notch provided on the other of the head and support member, the locking projection being selectively received in the at least one notch to lock the head in a particular orientation with respect to the support member.

9. An accessory cleaning tool according to claim 8 wherein two notches are provided on said other of the head and support member and the notches are positioned so that the head can be positioned in a first position in which the cleaning solution spray nozzle is adjacent the applicator pad and a second position in which the cleaning solution spray nozzle is adjacent the suction nozzle opening.

10. An accessory cleaning tool according to claim 1 and further comprising an elastomeric squeegee blade provided on one of said front and rear flanges of the cleaning head second edge.

11. An accessory cleaning tool according to claim 10 and further comprising a plurality of projections depending from the other of said front and rear flanges of the cleaning head second edge, the projections being adapted to space said other front and rear edge from the surface being cleaned so that fluid, dirt, and air can pass beneath said other front and rear edge into the suction nozzle opening.

12. In an improved water extraction cleaning machine comprising a source of cleaning solution, a pump for pressurizing said cleaning solution, a vacuum motor for creating a working airflow, a reservoir for receiving the working airflow and the used cleaning solution, dirt, and dust entrained therein, an accessory vacuum hose having a first end in fluid communication with the reservoir and vacuum motor, and a solution conduit having a first end in fluid communication with the pump, the improvement comprising:

an accessory cleaning tool comprising:

a support member having a working air passageway provided therein which is fluidly connected to the accessory vacuum hose of the cleaning machine and a cleaning solution spray nozzle provided thereon fluidly connected to the solution conduit of the cleaning machine to distribute cleaning solution onto a surface to be cleaned; and a cleaning head having first and second opposed edges, the first edge having an applicator pad provided thereon and the second edge having front and rear flanges defining a suction nozzle opening, a conduit between the suction nozzle opening and the working air passageway of the support member, and the cleaning head is rotatably mounted to the support member so that the alignment of the cleaning solution spray nozzle can be varied with respect to the suction nozzle opening and the applicator pad for different applications of the accessory cleaning tool.

13. An improved water extraction cleaning machine according to claim 12 wherein the cleaning head is rotatable on the support member between a first position in which the cleaning solution spray nozzle is adjacent the applicator pad and a second position in which the cleaning solution spray nozzle is adjacent the suction nozzle opening.

14. An improved water extraction cleaning machine according to claim 13 wherein the working air passageway has a longitudinal axis and the head is mounted for rotation about an axis substantially parallel to the longitudinal axis of the working air passageway.

15. An improved water extraction cleaning machine according to claim 14 wherein the support member further comprises a substantially tubular first bearing surface and the head further comprises a substantially tubular second bearing surface wherein the second bearing surface slides along the first bearing surface as the head is rotated with respect to the support member.

16. An improved water extraction cleaning machine according to claim 15 wherein the first bearing surface comprises at least a portion of the working air passageway and at least a portion of the second bearing surface is telescopically received inside the first bearing surface.

17. An improved water extraction cleaning machine according to claim 16 and further comprising at least one flexible locking projection provided on the second bearing surface and a locking surface formed on the inner surface of the working air passageway and substantially perpendicular to the first bearing surface, the at least one flexible locking projection being adapted to contact the locking surface to prevent inadvertent removal of the head from the support member.

18. An improved water extraction cleaning machine according to claim 12 and further comprising a locking projection provided on one of the head and support member and first and second notches provided on the other of the head and support member, the locking projection being selectively received in one of the two notches to lock the head in one of first and second positions, in the first position, the cleaning solution spray nozzle being adjacent the applicator pad and in the second position the cleaning solution spray nozzle being adjacent the suction nozzle opening.

19. An improved water extraction cleaning machine according to claim 12 and further comprising an elastomeric squeegee blade provided on one of said front and rear flanges of the cleaning head second edge.

20. An improved water extraction cleaning machine according to claim 19 and further comprising a plurality of projections depending from the other of said front and rear flanges of the cleaning head second edge, the projections being adapted to space said other front and rear edge from the surface being cleaned so that fluid, dirt, and air can pass beneath said other front and rear edge into the suction nozzle opening.

21. An accessory cleaning tool adapted to be used with a water extraction cleaning machine having a vacuum conduit and a solution conduit extending therefrom, the accessory cleaning tool comprising:

a support member having a working air passageway provided therein which is fluidly connected to the vacuum conduit of the cleaning machine, a cleaning solution spray nozzle provided thereon fluidly connected to the solution conduit of the cleaning machine to distribute cleaning solution onto a surface to be cleaned and a substantially tubular first bearing surface surrounding the working air passageway; and a cleaning head having a substantially tubular second bearing surface depending therefrom and first and second opposed edges, the first edge having an applicator pad provided thereon and the second edge having front and rear flanges defining a suction nozzle opening, and an elastomeric blade is provided on one of the front and rear flanges, the suction nozzle opening being in fluid communication with the working air passageway of the support member and at least a portion of the cleaning head being telescopically received inside the working air passageway of the support member so that the first and second bearing surfaces contact one another and the cleaning head is rotatably mounted to the support member for rotation between first and second positions, in the first position, the cleaning solution spray nozzle being adjacent the applicator pad and in the second position, the cleaning solution spray nozzle being adjacent the suction nozzle opening.

* * * * *